United States Patent [19]

Gartner

[11] Patent Number: 4,815,245

[45] Date of Patent: Mar. 28, 1989

[54] THERMAL-INSULATING WINDOW OR FACADE ARRANGEMENT IN THE TRANSPARENT AREA

[75] Inventor: Fritz Gartner, Gundelfingen, Fed. Rep. of Germany

[73] Assignee: Josef Gartner & Co., Gundelfingen, Fed. Rep. of Germany

[21] Appl. No.: 103,515

[22] Filed: Oct. 1, 1987

[30] Foreign Application Priority Data

Oct. 2, 1986 [DE] Fed. Rep. of Germany ..... 3633620

[51] Int. Cl.[4] ..... E04B 1/62

[52] U.S. Cl. ..... 52/171; 52/235; 49/DIG. 1

[58] Field of Search ..... 52/235, 788, 790, 171; 49/DIG. 1

[56] References Cited

U.S. PATENT DOCUMENTS 4,004,389 1/1977 DiFazio ..... 52/398

4,537,000 8/1985 Gartner ..... 52/235

4,545,161 10/1985 Baumann ..... 49/DIG. 1

4,640,672 2/1987 Muhle ..... 52/398

*Primary Examiner*—John E. Murtagh

*Attorney, Agent, or Firm*—Anthony J. Casella; Gerald E. Hespos

[57] ABSTRACT

The thermal-insulating window or the thermal-insulating facade faces in the transparent area are clamped in a frame (80) which is formed as composite profile with double insulation. The glazing (82) consists of a triple glazing, the panes (102, 104, 106) being connected via vapor-tight spacers (108, 110). The space between the panes is filled with noble gas. The outer faces of the panes (104, 106) are provided with an infrared-reflecting coating (112, 114). Arranged in front of the inner pane (106) is a face pane (118). By this construction of the frame (80) and the glazing (82) with the face pane (118) condensation at the inner side of the glazing (82) is prevented.

5 Claims, 2 Drawing Sheets

THERMAL-INSULATING WINDOW OR FACADE ARRANGEMENT IN THE TRANSPARENT AREA

BACKGROUND AND SUMMARY OF THE INVENTION

The invention relates to a thermal-insulating window or a facade arrangement in the transparent area, a glazing being clamped in a frame of composite profile.

In large-area windows or transparent facade areas the problem is encountered that the heat insulation of the frame or the profile at which the glazing is clamped is not sufficient to prevent condensing of moisture.

The invention is based on the problem of providing a highly thermal-insulating window or highly thermal-insulating transparent facade area.

This problem is solved according to the invention by the combination of the features (a) the frame is formed as composite profile with double insulation, (b) the glazing consists of a triple glazing with noble gas filling, (c) the spacers between the panes of the glazing consist of plastic, (d) the two inner panes of the glazing are provided on the outwardly directed surface with an infrared-reflecting coating, and (e) spaced from the inner pane of the glazing a face pane is arranged via heat-insulating spacer strips.

As a result of the simultaneous use of all the features according to the invention heat transport through the window or the transparent facade area is kept to a minimum value so that a total K value of about 0.7 is obtained. Formation of a condensation point at the inner pane of the triple glazing is prevented so that condensing of moisture at the glazing is also prevented.

According to a preferred embodiment the composite profile consists of three metal profiles connected in each case by means of at least one insulating rail. It would theoretically be possible to connect only two metal profiles via very wide insulating rails but the strength necessary for such composite profiles would then not be achieved.

Preferably, the face pane has a spacing of about 20 mm from the triple glazing.

BRIEF DESCRIPTION OF THE DRAWINGS

Examples of embodiment of the invention will be explained in detail hereinafter with the aid of the drawings, wherein.

DETAILED DESCRIPTION OF THE PREFERRED EMBODIMENT

Figure 1:
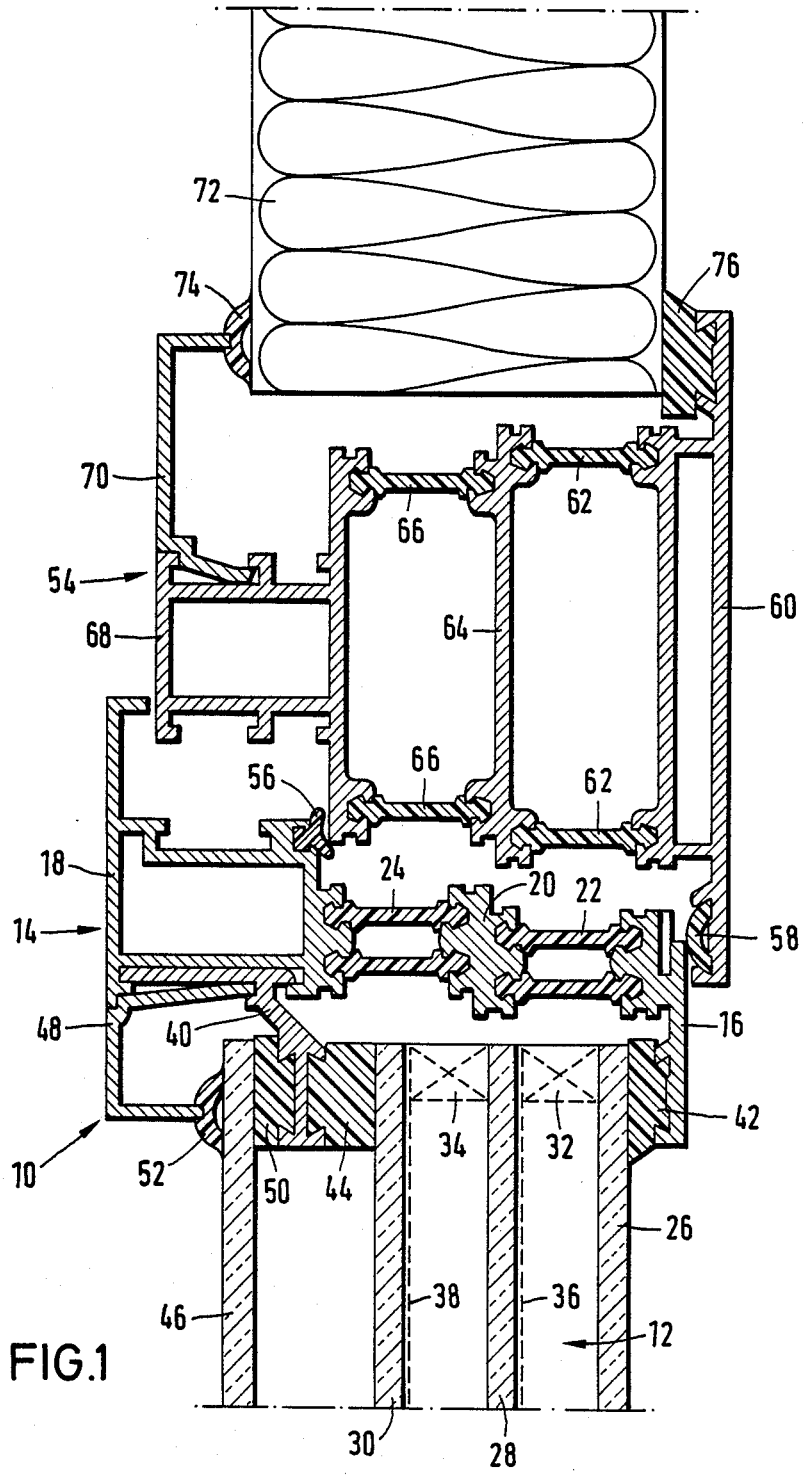
FIG. 1 is a section through an edge region of a window.

FIG. 1 shows a window 10 consisting of glazing 12 clamped in a frame 14. The frame 14 consists of a composite profile which is made up of an outer metal profile 16, an inner metal profile 18 and an intermediate profile 20 of metal as well as insulating rails 22 and 24. The insulating rails 22 and 24 consist of a plastic of poor thermal conductivity and are received with their thickened edges in undercut grooves at the metal profiles 16, 18 and 20.

The glazing 12 consists of three panes 26, 28 and 30. Between the plates or panes 26 and 28 an encircling spacer 32 is disposed and between the plates or panes 28 and 30 an encircling spacer 34 of plastic. The outwardly directed face of the plate or pane 28 is provided with an infrared-reflecting coating 36 and the outwardly directed face of the plate or pane 30 with an infrared-reflecting coating 38. The spaces between the plates or panes 26 and 28 as well as 28 and 30 are filled with a noble gas.

The glazing 12 is clamped by an outer metal profile 16 and a metal profile 40 which is anchored to the inner metal profile 18. Between the outer face of the pane 26 and the metal profile 16 a sealing strip 42 is inserted which with an undercut tongue 16 is anchored in an undercut groove in the metal profile 16. Anchored to the metal profile 40 is a sealing strip 44 which presses against the inner face of the pane 30. In front of the inner pane 30 of the glazing 12 a face plate or pane 46 is disposed which is pressed via a metal profile 48 against the metal profile 40. Between the face pane 46 and the metal profiles 40 and 48 sealing strips 50 and 52 respectively are disposed. Whereas the spacers 32 and 34 are made gas-tight the sealing strips 44 and 50 need not be vapour-tight. The metal profile 48 is anchored to the metal profile 40 and bears on the metal profile 18.

The frame 54 on which the frame 14 of the glazing 12 bears via sealing strips 56 and 58 is likewise made as composite profile with double insulation. In this case an outer metal profile 60 is connected via insulating rails 62 to a metal profile 64 which in turn is in connection via insulating rails 66 with an inner metal profile 68. The insulating rails 62 and 66 consist like the insulating rails 22 and 24 of a material of good thermal insulation. Between the outer metal profile 60 and a metal profile 70 anchored to the inner metal profile 68 a facade panel 72 is clamped via sealing strips 74 and 76.

Figure 2:
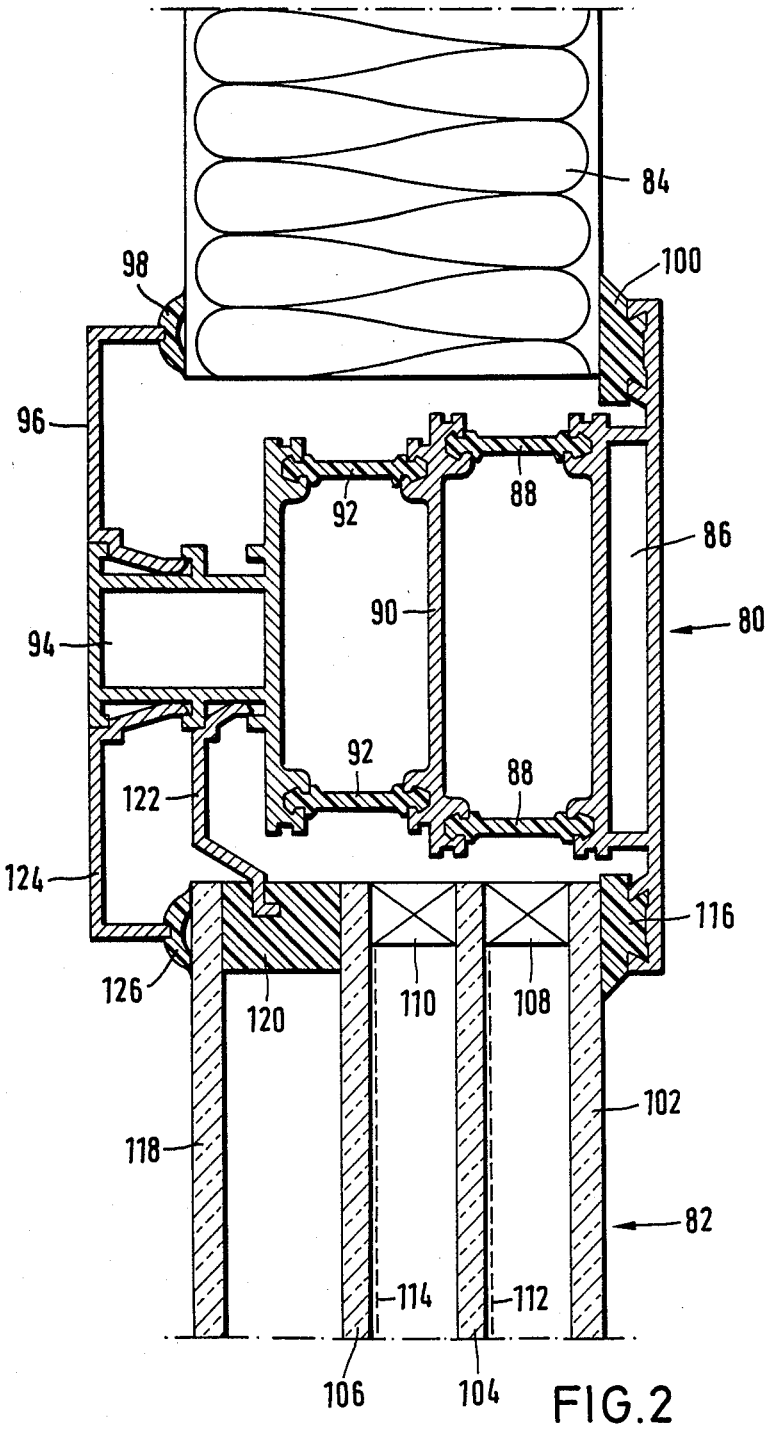
FIG. 2 is a section through the edge region of a fixed glazing.

FIG. 2 shows a frame 80 which is formed as composite profile with double insulation and to which a glazing 82 and a facade panel 84 are secured. The frame 80 consists of an outer metal profile 86 which is connected via insulating rails 88 to a metal profile 90. Anchored to the metal profile 90 are insulating rails 92 which are connected at the opposite edge to an inner metal profile 94. The panel 84 is clamped between the outer metal profile 86 and a metal profile 96 via sealing strips 98 and 100. The metal profile 96 is anchored to the inner metal profile 94 of the frame or facade profile 80.

The glazing 82 consists of three glass plates 102, 104 and 106 which are connected via encircling vapour-tight spacers 108 and 110. The outwardly directed faces of the panes 104 and 106 are provided with infrared-reflecting coatings 112 and 114. The space between the panes 102 and 104 and between the panes 104 and 106 is filled with a noble gas. Between the outer face of the pane 102 and the metal profile 86 a sealing strip 116 is disposed In front of the inner pane 106 of the glazing 82 a face pane 118 is disposed via a spacing strip 120. The spacing strip 120 is held by a metal profile 122 which is anchored to the inner metal profile 94. The face pane 118 is pressed via a metal profile 124 with interposition of a sealing strip 126 against the glazing 82. The metal profile 124 is anchored to the inner metal profile 94.

I claim:

1. Thermal-insulating window or facade arrangement in the transparent region, glazing being clamped in a frame of composite profile, characterized by the combination of the features:

(a) the frame (14, 80) is formed as composite profile with double insulation, (b) the glazing (12, 82) consists of a triple glazing of panes with noble gas filling, (c) the spacers (32, 34; 108, 110) between the panes (26, 28, 30; 102, 104, 106) of the glazing (12, 82) consist of plastic, (d) the two inner panes (28, 30; 104, 106) of the glazing (12, 82) are provided on the outwardly directed surface with an infrared-reflecting coating (36, 38; 112, 114), and (e) spaced from the inner pane (30, 106) of the glazing (12, 82) a face pane (46, 118) is arranged via heat-insulating spacer strips (44, 50; 120).

2. Window or facade arrangement according to claim 1, characterized in that the composite profile (14, 18) consists of three metal profiles (16, 18, 20; 86, 90, 94) each connected via at least one insulating rail (22, 24; 88, 92).

3. Window or facade arrangement according to claim 1 characterized in that the face pane (45, 118) is spaced about 20 mm from the glazing (12, 82).

4. Window or facade arrangement according to claim 2, characterized in that the face pane (45, 118) is spaced about 20 mm from the glazing (12, 82).

5. A thermal-insulating window comprising a transparent region defined by glazing, said glazing being clamped in a frame, said frame being formed as a composite profile with double installation, said glazing comprising a triple glazing formed from an inner pane, an intermediate pane, and an outer pane, with a noble gas filling disposed intermediate said panes, plastic spacers being disposed intermediate the panes of the glazing, the inner pane and the intermediate pane being provided with an infrared-reflecting coating disposed on the respective surfaces thereof facing the outer pane, and a face pane spaced from said inner pane and on the side thereof opposite said intermediate pane, said face pane being mounted with heat-insulating spacer strips.

* * * * *